United States Patent [19]

Gershnow

[11] 3,940,726

[45] Feb. 24, 1976

[54] HIGH SPEED SOLENOID EMPLOYING MULTIPLE SPRINGS

[75] Inventor: Abraham H. Gershnow, Nashua, N.H.

[73] Assignee: Centronics Data Computer Corporation, Hudson, N.H.

[22] Filed: Aug. 22, 1974

[21] Appl. No.: 499,632

[52] U.S. Cl. ..... 335/274; 197/1 R; 335/192

[51] Int. Cl.² ..... H01F 7/16

[58] Field of Search ..... 197/1 R, 17; 335/274, 257, 335/192, 193

[56] References Cited

UNITED STATES PATENTS

| | | | |
|---|---|---|---|
| 2,417,438 | 3/1947 | O'Brien et al. | 335/257 |
| 3,831,729 | 8/1974 | Howard | 335/274 |

*Primary Examiner*—Harold Broome

*Attorney, Agent, or Firm*—Ostrolenk, Faber, Gerb & Soffen

[57] ABSTRACT

A high speed solenoid assembly especially adapted for use in impact printers of the dot matrix type. The solenoid coil, when energized, drives the solenoid armature and a print wire connected thereto for impact against an inked ribbon and paper document to form a dot upon the paper document. The armature is initially driven against the biasing force of a "weak" spring to facilitate rapid acceleration to impact velocity. Just before the print wire strikes the inked ribbon and paper document, the armature comes under the influence of a "kicker" spring having a greater spring force and which is flexed by the moving armature which serves to return the armature to the non-impact position at a more rapid rate when the solenoid coil is deenergized.

The use of a headed armature with a depression along its rear surface serves to significantly reduce armature "bounce". The assembly significantly reduces elapsed time between movement of the armature and print wire from the rest position to the impact position and return of the armature to the rest position enabling significantly increased printing speeds.

18 Claims, 13 Drawing Figures

FIG. 3.
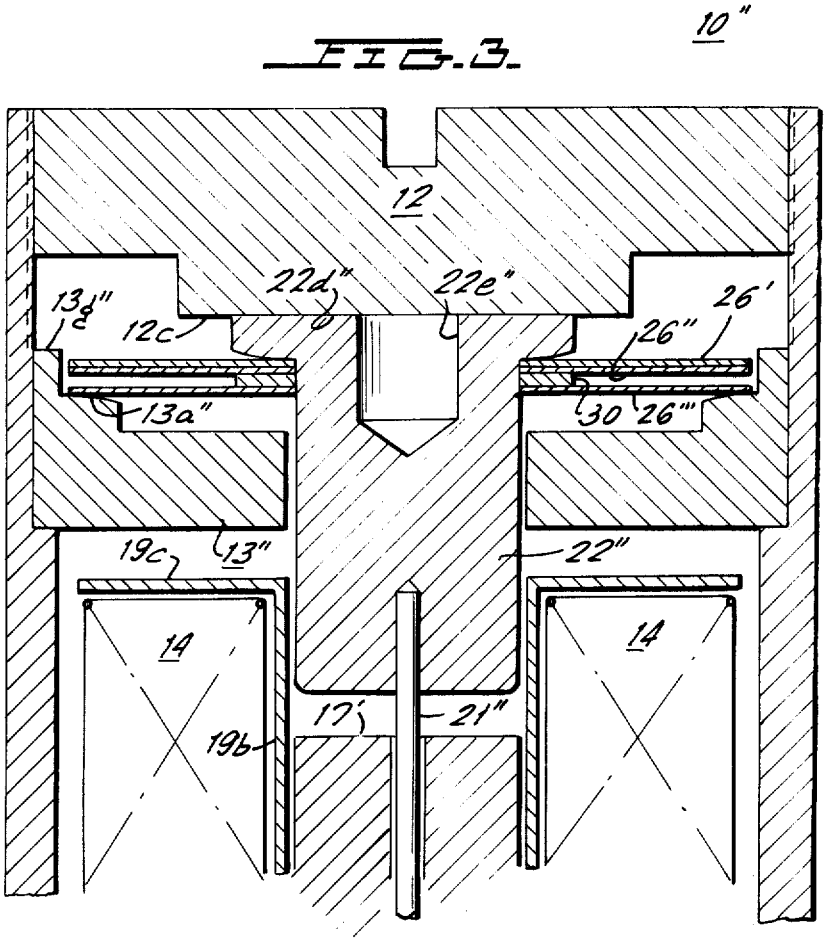
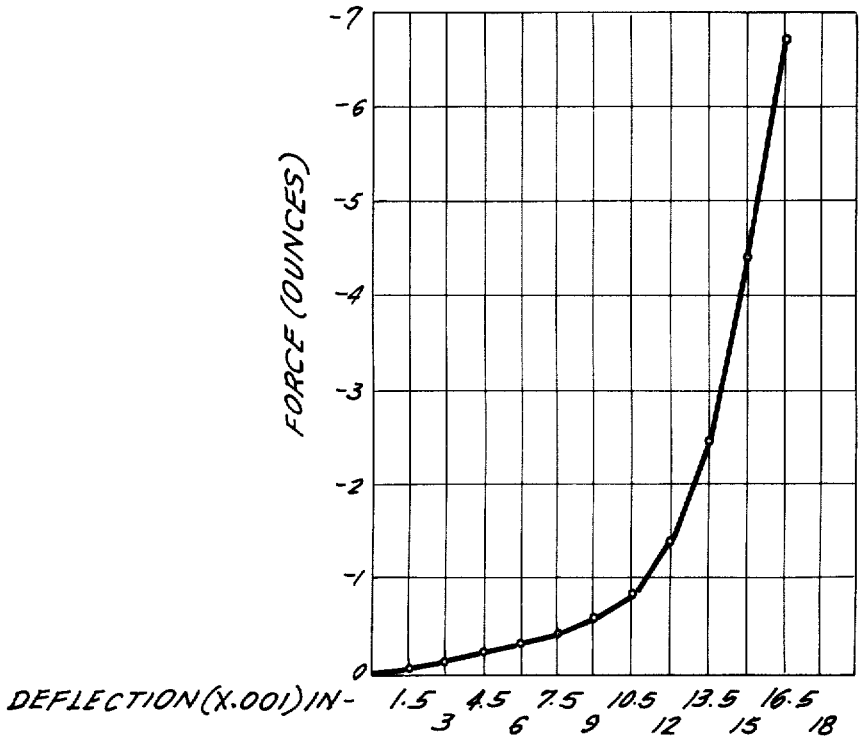
FIG. 1d.

FIG. 5.
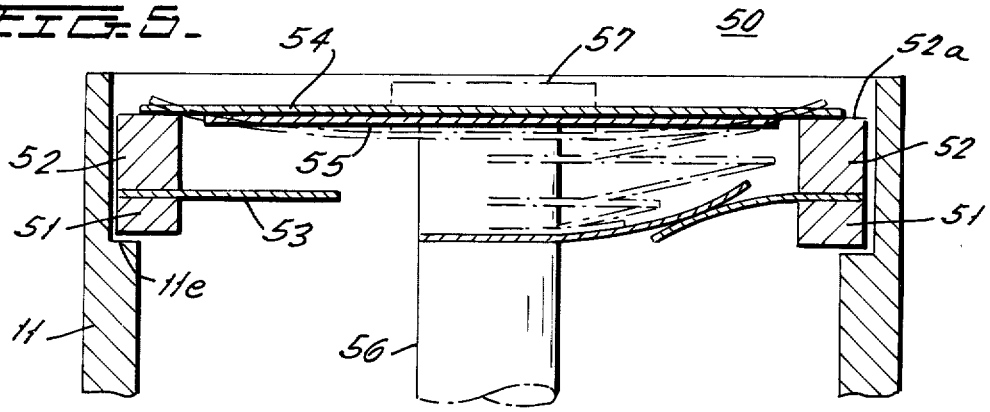
FIG. 6.
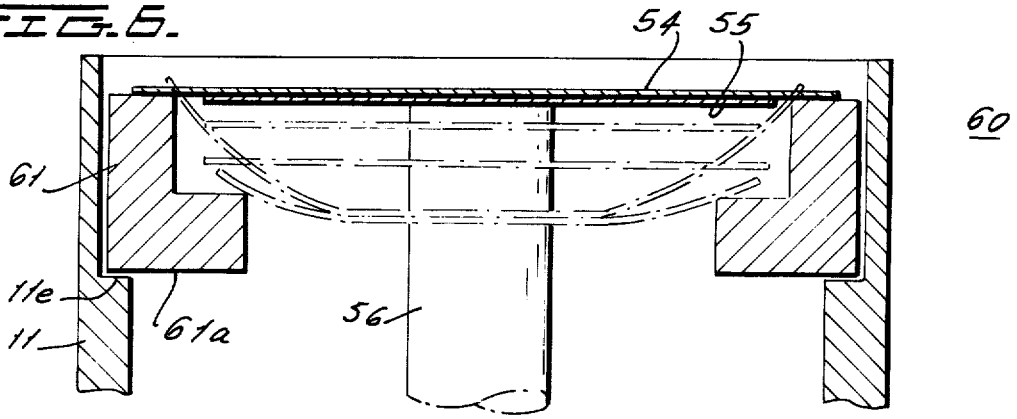
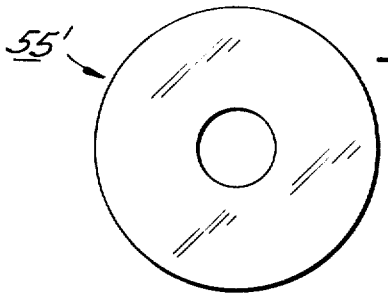
FIG. 8.
FIG. 7.
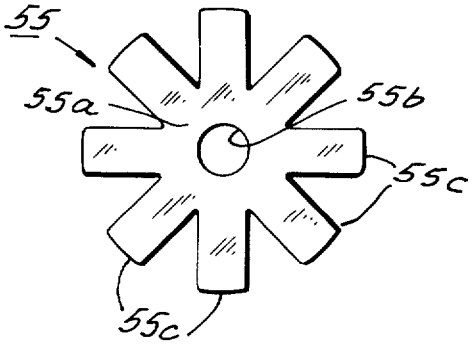
FIG. 9.
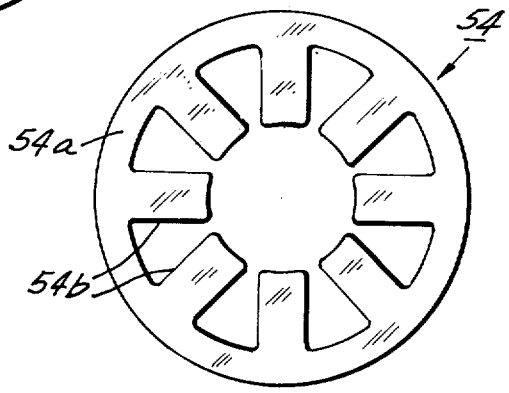

HIGH SPEED SOLENOID EMPLOYING MULTIPLE SPRINGS

BACKGROUND OF THE INVENTION

The present invention relates to impact printers and more particularly to a novel multiple spring high speed solenoid assembly for use in such impact printers.

Dot matrix printers are typically comprised of a plurality of solenoid driven wires mounted within a movable print head which traverses a paper document. During movement of the print head across the paper document selected solenoids are energized and drive their associated print wires against an inked ribbon and ultimately against the paper document to form dot column patterns at closely spaced intervals across the line of print. In one typical embodiment the print head utilizes seven solenoid driven print wires and successively forms five dot column patterns which collectively form a character, each character being formed within a 5 × 7 dot matrix. Selective energization of the solenoids permits the generation of alphabetic and numeric characters, punctuation symbols and the like.

In 132 column printers i.e., printers capable of printing 132 characters per line of print with each character formed within a 5 × 7 dot matrix, each individual solenoid may operate as many as 660 times per printed line. In the formation of graphic patterns, each solenoid may be caused to operate up to 792 times per line of print.

The print wires are typically spaced of the order of 0.006 inches from the inked ribbon and paper document. The total distance travelled by a print wire is of the order 0.015 inches. Positioning the forward ends of the print wires a distance less than 0.015 inches from the paper document takes into account some of the force which is absorbed by the ribbon and paper document upon impact.

Conventional printers of the above mentioned category are capable of printing at the rate of 330 characters per second and 125 lines per minute (for lines of 132 character length). In order to achieve these print speeds, the print wire must be capable of being accelerated from a rest position to a velocity sufficient to form a dot on the original document and typically five carbon copies and return to its rest position in less than one millisecond. It has been found to be impractical to obtain faster operating speeds using conventional present day solenoid designs.

BRIEF DESCRIPTION OF THE INVENTION

The present invention is characterized by providing a novel high speed solenoid assembly for wire matrix printers utilizing a multiple spring design for increasing print wire operating speeds to a level not heretofore attainable through present day designs.

The solenoid assembly comprises a case for housing an annular shaped solenoid coil having a hollow core. A cylindrical shaped magnetic core stem has its rearward portion positioned within the hollow core of the solenoid winding and is provided with an elongated axial opening for receiving a slender reciprocating print wire. The rear end of the print wire extends beyond the rearward end of the solenoid winding and is affixed to a headed armature having a substantially flat annular-shaped weak spring affixed thereto.

The outer periphery of the weak spring rests upon one surface of an annular-shaped flux ring. The flux ring is provided with a recessed ledge for supporting the periphery of an annular-shaped "kicker" spring which, in one preferred embodiment has its inner periphery spaced from the headed armature and in another preferred embodiment has its inner periphery affixed to the headed armature and its outer periphery spaced from the recessed shoulder of the flux ring.

The rearward end of the solenoid assembly case is fitted with an end cap which seals the case and further serves as both a stop means and a positioning means for the headed armature.

The headed armature is provided with a recess in its rearward surface which cooperates with the confronting surface of the end cap to provide a dash-pot action serving to significantly reduce bounce which occurs as a result of movement of the armature toward the rest position. Alternatively, the end cap may be provided with a recess and the rear face of the armature may be flat.

Upon energization of the solenoid coil the armature is accelerated toward impact velocity rapidly overcoming the biasing force of the weak spring. After the armature has achieved print velocity and just before impact, the "kicker" spring is flexed by the armature to provide a biasing force of sufficient magnitude to rapidly return the armature to the rest position after deenergization of the solenoid. This design reduces the elapsed time between acceleration of the armature from the rest position to the time which the armature which returns to the rest position to approximately one-half the elapsed time encountered in conventional print wire solenoid assemblies.

BRIEF DESCRIPTION OF THE FIGURES AND OBJECTS

It is therefore one object of the present invention to provide a novel solenoid assembly for use in wire matrix printers and the like in which a multiple spring design is employed for significantly increasing solenoid operating speeds and hence increasing print rates.

Still another object of the present invention is to provide a novel solenoid assembly for use in impact printers of the dot matrix type in which multiple springs are utilized for selectively biasing the solenoid armature to effectively double the solenoid operating speed and hence effectively double the printing speed.

Still another object of the present invention is to provide a solenoid assembly for use in impact printers of the dot matrix type in which biasing forces are imposed upon the armature assembly in staggered fashion to increase both acceleration and return rates of the solenoid armature.

Still another object of the present invention is to provide a novel solenoid assembly for use in impact printers of the dot matrix type employing a novel headed armature which is designed to reduce side loading forces and acceleration times and which further significantly reduces armature bounce normally encountered during return of the armature to the rest position.

The above as well as other objects of the present invention will become apparent when reading the accompanying description and drawings in which:

FIG. 1 shows a sectional view of a solenoid assembly designed in accordance with the principles of the present invention.

FIG. 1*a* shows an enlarged detailed view of the armature and multiple spring assembly of FIG. 1.

FIGS. 1*b* and 1*c* show plan views of the disc and wire wheel springs employed in the solenoid assembly of FIG. 1.

FIG. 1*d* is a plot showing a curve relating static force to deflection distance and which is useful in describing the operation and advantages of the present invention.

FIG. 3 shows a sectional detailed view of still another embodiment of the present invention.

FIGS. 4–6 show sectional views of other preferred embodiments of the present invention.

FIGS. 7–9 show plan views of three springs employed in the embodiments of FIGS. 4–7.

DETAILED DESCRIPTION OF THE INVENTION

Figure 1:
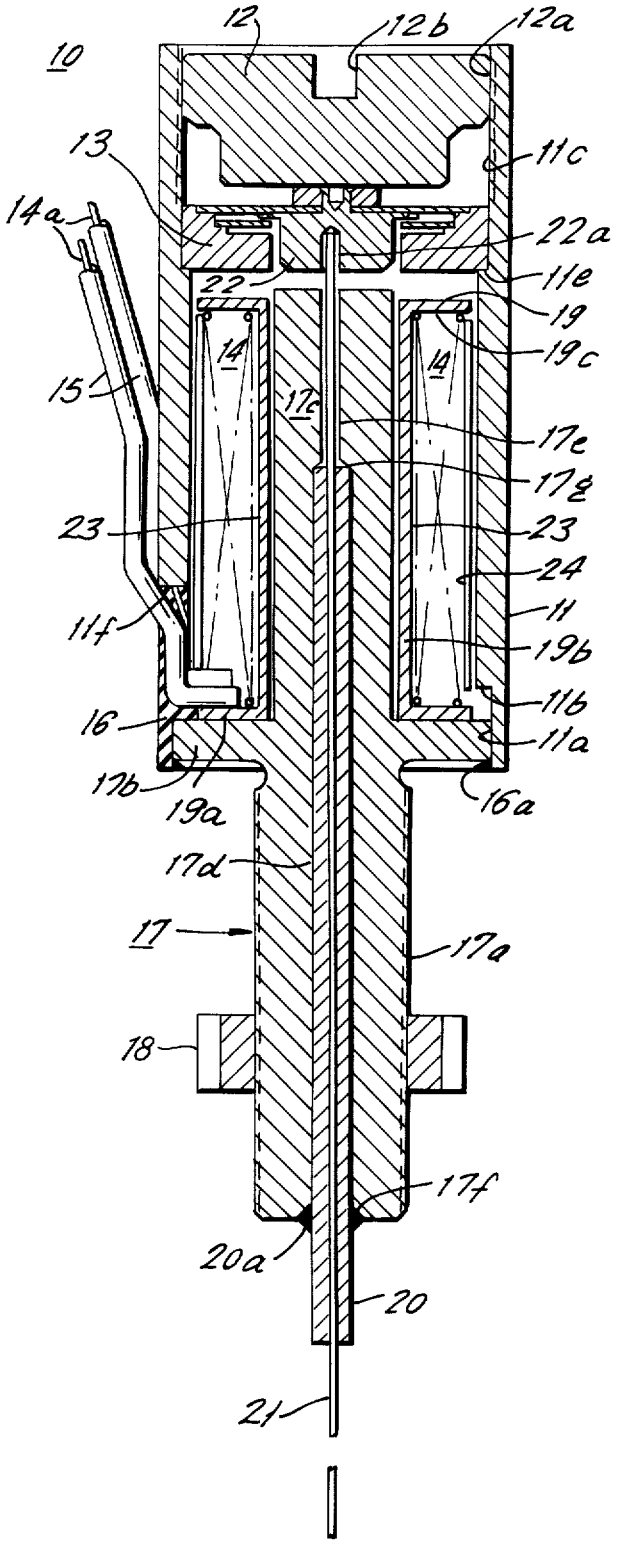
Figure 1B:
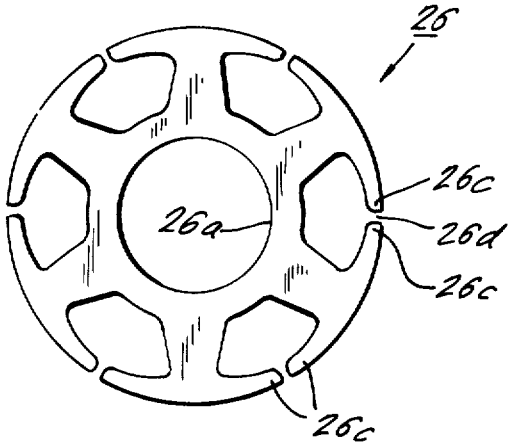
Figure 1C:
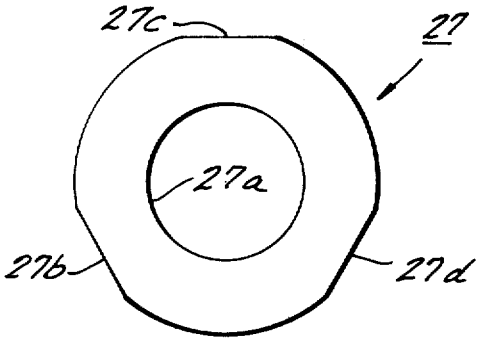
Figure 1A:
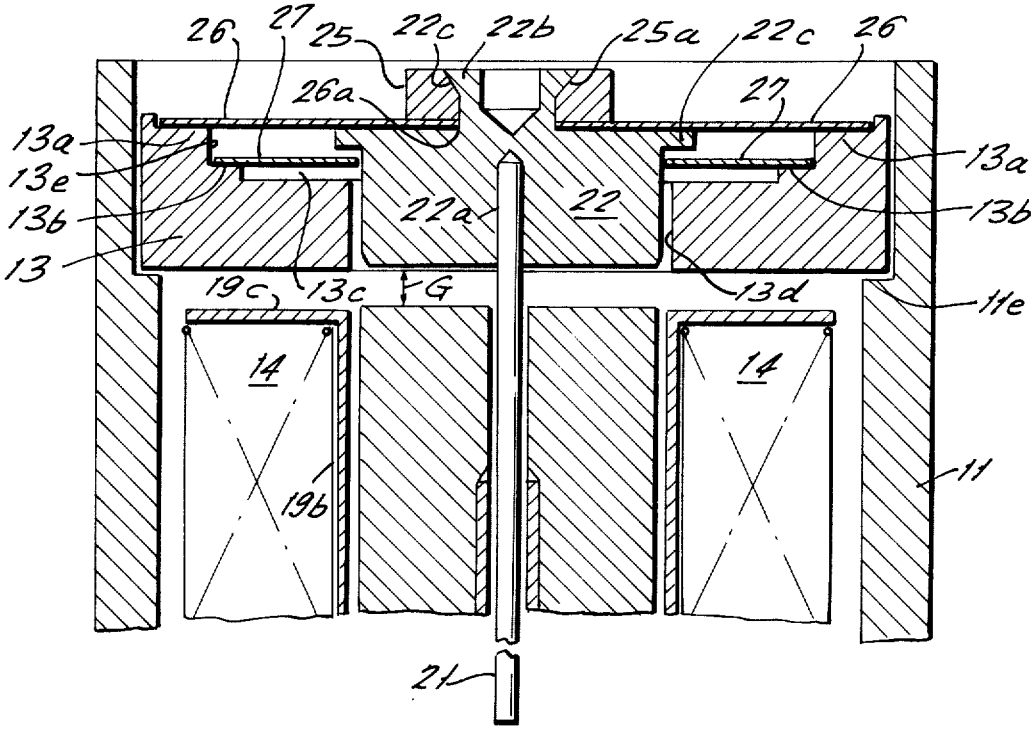

Referring initially to FIGS. 1 and 1*a*, there is shown therein a solenoid assembly 10 having a hollow cylindrical-shaped case 11 provided with an interior surface 11*a* of increased diameter and terminating in a recessed shoulder 11*b* spaced inwardly from the left-hand end of the case. The right-hand interior end of the case 11 is tapped at 11*c* for threadedly engaging the threaded portion 12*a* of end cap 12.

An internal shoulder 11*e* serves as a support for flux ring 13, to be more fully described.

A forward portion of case 11 is slotted at 11*f* to provide a passageway for the connecting leads 14*a* of solenoid coil 14. The connecting leads are electrically insulated by tubular sleeves 15. After assembly, slot 11f is filled with a suitable epoxy, as shown at 16.

A core stem 17 has an elongated threaded portion 17*a* which threadedly engages a lock nut 18. The threaded portion 17*a* is adapted to be threadedly engaged within a tapped aperture provided in a print head housing rear wall shown, for example, in FIG. 3 of U.S. Pat. No. 3,690,431 issued Sept. 12, 1972 and assigned to the assignee of the present invention. FIG. 3 of the above mentioned patent shows a rear wall 32 having tapped apertures 33 for receiving the threaded portion of core stem 17. Once the core stem and hence the solenoid assembly is properly adjusted, locking nut 18 is firmly tightened against the surface of the housing rear wall to secure the solenoid assembly in position.

The intermediate portion of core stem 17 is provided with an annular-shaped flange 17*b* which is fitted within the increased diameter portion 11a provided at the left-hand end of casing 11. The right-hand surface of flange 17*b* rests against the left-hand circular shaped flange 19*a* of bobbin 19 upon which the solenoid coil 14 is wound. After all of the elements of the solenoid assembly are assembled and adjusted, the core stem is spot welded to the casing. A suitable epoxy is deposited about the left-hand marginal portion of flange 17*b* to seal the slot in case 11 through which leads 14 extend.

The rearward portion 17*c* of core stem 17 extends substantially completely through the hollow core in bobbin 19. Core stem 17 is formed of a suitable material such as, for example, silicon iron to provide high magnetic permeability for a purpose to be more fully described.

Core stem 17 is further provided with an axially aligned elongated opening comprised of a first portion 17*d* of increased diameter which communicates with an opening portion 17*e* of reduced diameter. The front face of core stem 17 has a tapered portion 17*f* which facilitates the insertion of a hollow tubular elongated non-magnetic wire tube guide 20 whose left-hand end terminates at the tapered shoulder 17*g* between the openings 17*d* and 17*c*. The tube guide 20 is epoxied to core stem 17 as shown by epoxy 20*a*. The interior surface of tube guide 17 is preferably coated with a dry lubricant to minimize wearing of print wire 21. Print wire 21 is an elongated substantially cylindrical shaped flexible metallic member, of high compressive strength and durability.

The forward or left-hand end of print wire 21 is adapted to be impacted against an inked ribbon and paper document typically supported by a platen (not shown) to form a "dot" upon the paper document. The print wire 21 slidably engages the interior surface of tube guide 21, extends through narrow diameter opening 17e and is spaced inwardly therefrom, and extends beyond the right-hand face of core stem 17 with its free end positioned within an opening 22*a* in headed armature 22. Print wire 21 is soldered or otherwise secured to armature 22.

Solenoid coil 14 is a hollow elongated coil wound upon the cylindrical core 19*a* of hollow bobbin 19 and has its opposite ends extending between and confined by flanges 19*a* and 19*c* of bobbin 19. The end terminals extend through slot 11f providing connecting leads 14a to facilitate electrical connection to a solenoid driver circuit such as, for example, the circuit shown in FIG. 4 of the above mentioned U.S. Pat. No. 3,690,431. Insulating tapes 23 and 24 are respectively wrapped about the exterior cylindrical peripheries of bobbin cylinder 19*b* and coil 14.

The headed armature 22 has its left-hand face positioned a spaced distance from the right-hand face of core stem 17 (note especially FIG. 1*a*). The right-hand face of armature 22 is provided with a rearwardly extending cylindrical shaped portion 22*b* which is initially perfectly straight and cylindrical along its exterior periphery to facilitate the insertion of cylindrical projection 22*b* through the central shaped opening 26*a* in spring 26. Thereafter, cylindrical projection 22*b* is inserted through the central opening in a ring-shaped metallic spring retainer 25. The cylindrical projection 22*b* is then swaged to form flared portion 22*c* which bears against the bevelled surface 25*a* of spring retainer 25 surrounding the central opening to spring retainer 25 and hence spring 26 to armature 22.

Flux ring 13 is preferably formed of a material of high magnetic permeability such as, for example, silicon iron and aids in directing magnetic flux through armature 22 as will be more fully described herein below in greater detail.

The left-hand margin of flux ring 13 abuts against shoulder 11*e* in case 11. Flux ring 13 is provided with first and second spaced recessed annular surfaces 13*a* and 13*b*. The left-hand marginal periphery of spring 26 rests against recess 13*a*. A second spring 27 has its left-hand marginal periphery resting against recessed surface 13*b*. A central recess 13*c* spaced inwardly from annular shaped surface 13*b* provides a hollow interior space between the left-hand surface of spring 27 and recess 13*c*. Flux ring 13 has a central opening 13*d* through which armature 22 extends.

Spring 27 has a central opening whose diameter is such that the interior periphery of spring 27 lies a spaced distance from the cylindrical periphery of armature 22.

FIG. 1*b* shows a plan view of spring 26 which is comprised of a central opening 26*a* through which cylindrical shaped projection 22b extends (see FIG. 1a). The central portion of spring 26 surrounding opening 26a is clamped between armature 22 and spring retainer 25 and has a plurality of spokes which extend radially outward from the center of spring 26 and have tapering sides whose width narrows toward the free ends thereof which are each provided with arcuate shaped portions 26c extending on opposite sides of each spoke portion and spaced from adjacent arcuate shaped portions by a narrow gap 26d. The arcuate portions 26c rest upon annular shaped recessed surface 13a of flux ring 13.

FIG. 1c shows a plan view of spring 27 having a central opening 27a and a substantially circular outer periphery which is truncated at 27b, 27d and 27c, respectively to reduce bending stresses. Alternatively, spring 27 may be of the type shown in FIG. 1b and having a greater spring constant and which may be of greater thickness or may be comprised of two springs of the type shown in FIG. 1c and arranged in stacked fashion.

The end cap 12 (note especially FIG. 1) threadedly engages case 11 and is provided with a square shaped groove 12b aligned along one diameter thereof for receiving an adjusting tool such as, for example, the head of a screwdriver for tightening and adjusting the end cap and hence armature 22. The left-hand face 12c of end cap 12 projects into the interior of case 11 and has a substantially flat surface which abuts the right-hand surface of retainer ring 25. Retainer ring 25 and hence armature 22 may be moved to the left relative to FIG. 1 by appropriate adjustment of end cap 12 so as to flex spring 26 and thereby adjust the preloading of the armature. After the end cap and hence the armature is adjusted for both preloading and positioning relative to the right-hand surface of core stem 17, end cap 12 may be secured into position by depositing a suitable epoxy at the diametric ends of slot 12b and against the interior surface portions of case 11 adjacent slot 12b.

The operation of the solenoid assembly is as follows:

Initially solenoid coil 14 is deenergized and armature 22 is in the rest position with spring retainer 25 abutting surface 12c of end cap 12. At this time spring 26 is usually under slight flexure providing the proper spring preloading and gap position between armature 22 and core stem 17.

The energization of the solenoid coil causes the armature to move toward the left whereby spring 26 undergoes further flexure. The magnetic field generated by coil 14 extends and is concentrated through core stem portion 17c, flange 17b, casing 11 (which is preferably formed of silicon iron), flux ring 13, spring 26 (which is preferably formed of spring steel), armature 22 and a cross gap G between core stem 17 and armature 22, thus increasing the magnitude of the flux in air gap G, which increases the acceleration of the armature.

The "spokes" 26b of spring 26 are caused to flex against the greater force of the magnetic field substantially rapidly accelerating armature 22 toward impact velocity.

Initially the inner periphery of spring 27 is spaced from flange 22c provided around the periphery of armature 22 and exerts no biasing force whatsoever upon the armature so that the only biasing force initially imparted upon armature 22 is the biasing force of spring 26 (having a "weak" spring constant) and the inertia required to move the mass of the armature.

From a consideration of FIG. 1d, it can be seen that the force (measured in ounces) required to move armature 22 a distance of 0.0105 inches is less than 1 ounce. The amount of force required to move the print wire 21 and hence the armature 22 a distance of the order of 0.015 inches (i.e. the distance necessary to form a dot on the paper document) is of the order of 4.4 ounces. Thus, armature 22 has achieved a substantial velocity before flange 22c abuts against the inner marginal portion of spring 27.

Spring 27 is a substantially solid disc member and has a significantly greater spring constant than the "wagon wheel" type spring 26. Armature 22 has thus achieved a sufficient velocity to cause spring 27 to flex just prior to the moment that the left-hand end of print wire 21 impacts the inked ribbon and paper document. As can be seen from FIG. 1d, the spring biasing force increases rapidly as the armature travels through the last few thousands of inches in impacting the paper document serving to absorb some of the impact and impart sufficient energy to spring 26.

Solenoid coil 14 is deenergized by a square-wave drive pulse approximately 225 microsecond duration. There is an elapsed time of the order of 250 microseconds between the time that the drive pulse is first applied and the time that the print wire impacts the paper document. An elapsed time of the order of 250 microseconds is required to return the armature to the rest position. Thus, the drive pulse to the solenoid coil is terminated approximately 25 microseconds prior to the time that the print wire impacts the paper document placing armature 22 under the influence of the biasing forces of springs 26 and 27. The significantly greater spring force of solid disc spring 27 exerts the major influence upon armature 22 causing it to move rapidly toward the rest position.

The central opening in projection 22b cooperates with the confronting surface 12c of end cap 12 to create a "dash-pot" action which significantly attenuates armature bounce thus rapidly bringing the armature to the rest position. Experimentation has shown that elapsed operating time for solenoid 10 and moving armature 22 from the rest position to the impact position and back to the rest position is less than 500 microseconds which is approximately one-half the elapsed time of conventional solenoids thus providing printing rates double that of existing dot matrix printers. The dash-pot action greatly reduces wearing of the end cap surface 12c thereby maintaining the desired air gap G between armature 22 and core stem 17.

Figure 2:
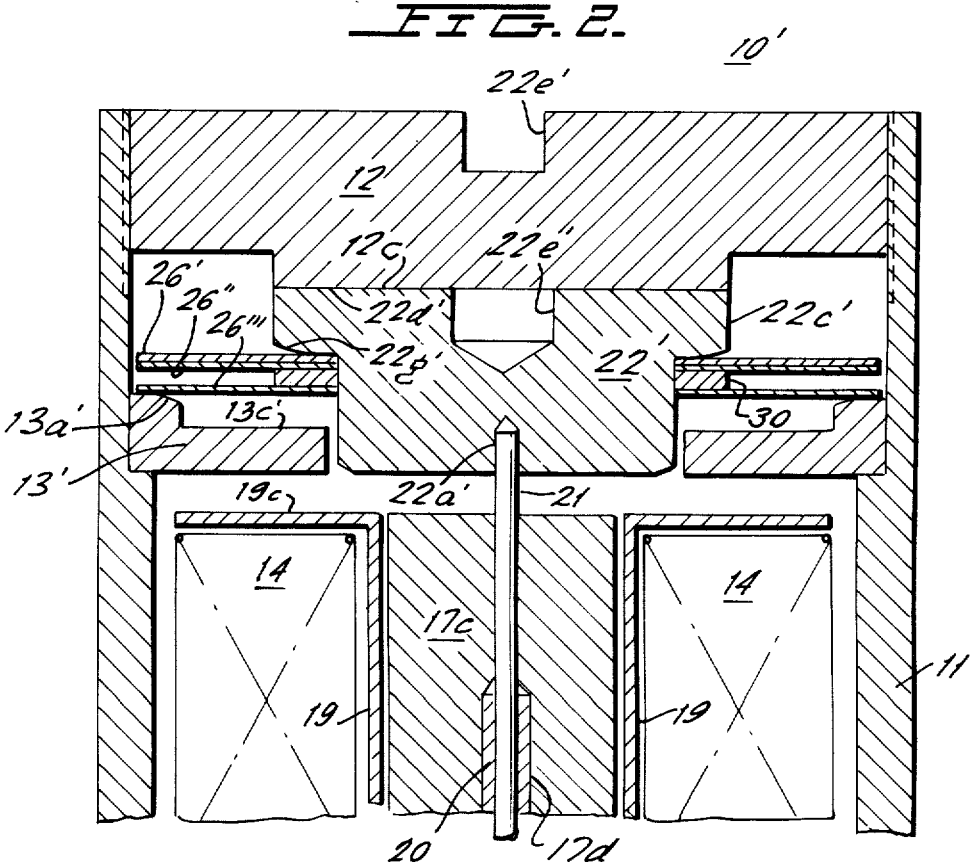
FIG. 2 is a sectional view of a solenoid assembly showing another preferred embodiment of the present invention.

FIG. 2 shows another preferred embodiment of the present invention wherein like portions of the solenoid assembly have been designated by like numerals. The embodiment of FIG. 2 differs from that of FIGS. 1 and 1a in that the headed armature 22' has a flat rear surface 22d' provided with a central recess or opening 22e'.

Flux ring 13' is provided with a curved annular surface 13a' spaced inwardly from annular surface 13a'.

The embodiment 10' of FIG. 2 is provided with first, second and third "wagon wheel" type spring members 26', 26'' and 26''' having central openings for receiving the forward end of armature 22'. A flat ring-shaped metallic spacer 30 is positioned between springs 26'' and 26'''. This arrangement eliminates the need for mechanically securing any of the springs to the armature thus simplifying assembly and/or disassembly.

The flat rear surface 22d' of armature 22' abuts against the interior surface 12c of end cap 12.

The forward surface 22g' of armature flange 22c' is slightly curved as shown. The outer marginal portion of spring 26''' rests upon the curved surface 13a' of flux ring 13 while the outer peripheries of springs 26' and 26'' can be seen to lie a spaced distance away from spring 26''' and hence from surface 13a' of the flux ring.

The operation of the alternative embodiment of FIG. 2 is substantially similar to that of the solenoid assembly of FIG. 1 wherein, upon energization of solenoid coil 14, the magnetic flux set up by the coil rapidly overcomes the spring biasing force exerted by spring 26''' on armature 22' to rapidly accelerate the armature toward impact velocity. This is due to the weak spring constant of Wagon Wheel type spring 26'''.

After armature 22' has undergone significant acceleration toward the impact velocity, the outer marginal portion of spring 26''' abuts against the outer periphery of spring 26''' causing both springs 26' and 26'' to begin flexing. The increased spring force of springs 26' and 26'' absorbs some of the impact velocity causing these two springs to flex and store this energy in the form of flexures.

Upon deenergization of coil 14, armature 22' comes under the influence of the energy stored in springs 26', 26'' and 26''' causing the armature to return rapidly to the rest position. Opening 22e' in the rear face of armature 22' cooperates with the forward face 12c of end cap 12 to provide a dash-pot action to reduce armature bounce and hence rapidly bring the armature to the rest position. The shorter armature which does not protrude into the core of coil 14 reduces the mass of the armature thereby increasing the acceleration of the armature. Also centering of the armature is simplified. Spring 26'' also serves as a means for accurately centering armature 22' along the longitudinal axis of the solenoid.

FIG. 3 shows still another embodiment of the present invention wherein like elements of FIGS. 1, 2 and 3 are designated by like numerals. The embodiment of FIG. 3 differs from that of FIGS. 1 and 2 in that core stem 17' has its rearward face positioned inwardly from flange 19c of bobbin 19 and in that armature 22'' is of a narrower diameter and is longer than armature 22' or 22 so as to extend into the hollow annular region defined by the cylindrical portion 19b of bobbin 19.

Flux ring 13'' is provided with a curved annular surface 13a'' which is spaced inwardly from a flat annular surface 13g''. Springs 26', 26'' and 26''' and ring-shaped spacer 30 are substantially the same as the elements shown in FIG. 2. The rear surface 22d'' of armature 22' is provided with an aperture 22e'' of greater depth than that shown in FIG. 2.

The operation of the solenoid assembly 10'' of FIG. 3 is substantially the same as that shown in FIG. 2 wherein, upon energization of coil 14, the only spring force initially imparted to armature 22'' is the spring force of wagon wheel type spring 26'''. Once armature 22' has moved a distance of the order of 0.010 inches (i.e., the thickness of spacer 30) the outer marginal portion of spring 26'' abuts the outer periphery of spring 26''' imposing additional spring forces of springs 26' and 26'' upon armature 22''. Some of the force of accelerating armature 22' is absorbed and stored in springs 26' and 26'' which undergo flexure.

Upon deenergization of solenoid coil 14, armature 22'' is under the influence of all three springs which rapidly return armature 22' toward the rest position. Opening 22e'' and the flat surface 12c of end cap 12 provide the aforementioned dash-pot action to rapidly bring armature 22' to rest.

Figure 4:
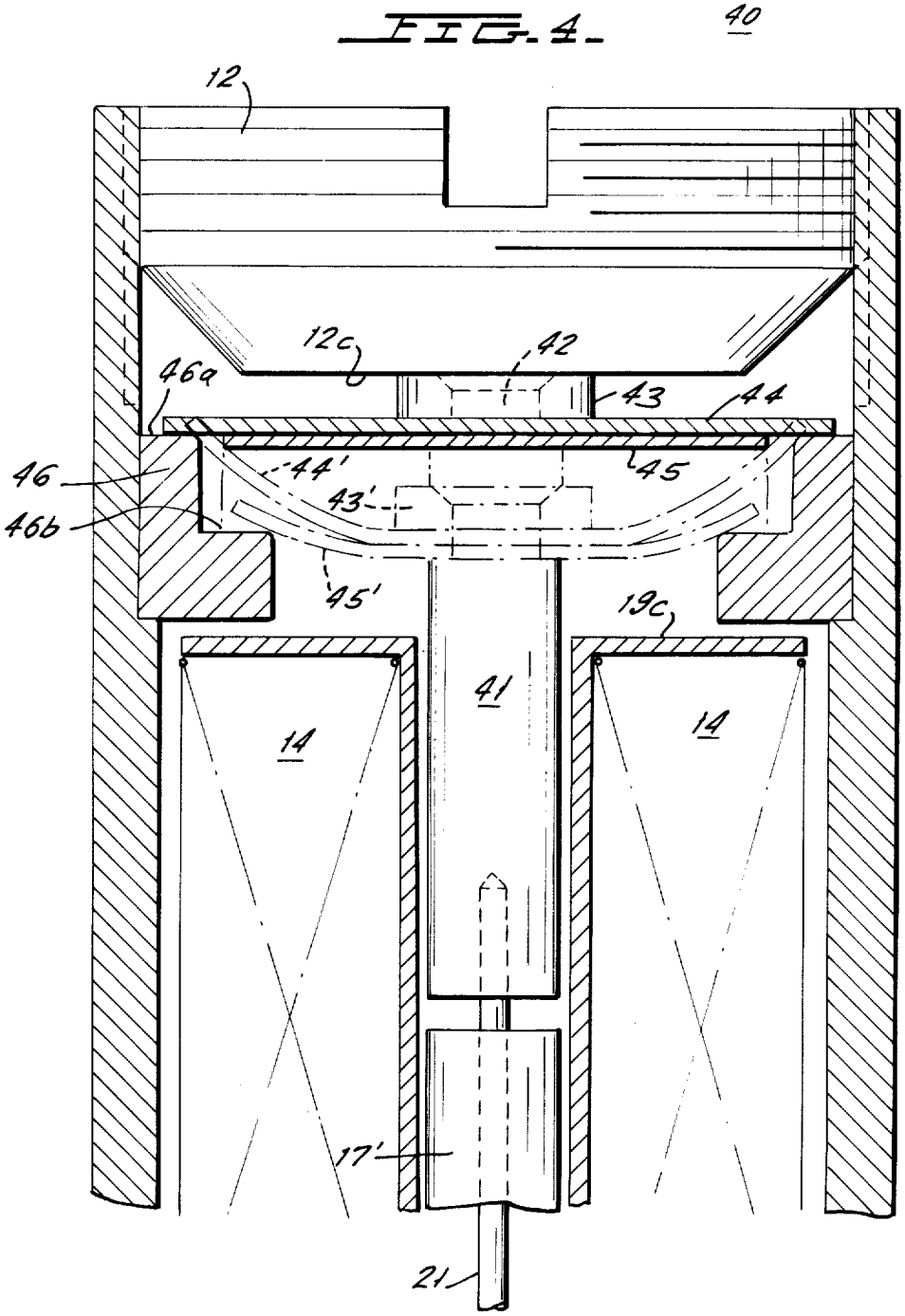

FIG. 4 shows still another embodiment of the present invention which is comprised of a core stem 17' whose rear face terminates inwardly from flange 19c of bobbin 19.

Armature 41 has a rearwardly extending projection 42 which receives spring retainer 43 to retain springs 44 and 45 of weak spring force thereto. In the rest position the outer periphery of spring 44 rests upon annular shaped surface 46a of flux ring 46 while the periphery of spring 45 is positioned a spaced distance above the recessed annular surface 46b of flux ring 46.

When solenoid coil 14 is energized, armature 41 begins to move toward core stem 17' and is initially under the influence of only spring 44 which begins to flex as the armature moves toward core stem 17'. Spring 44 has a weak spring force enabling armature 41 to easily overcome this spring force and rapidly accelerate towards impact velocity. As the print wire 21 is about to impact the paper document the periphery of spring 45 moves from the solid line position to the dotted line position 45' causing the spring to flex and store some of the force imported to spring 45 by by armature 41. Once the solenoid coil is deenergized, armature 41 is biased by flexed springs 44 (occupying the flex position 44') and flex spring 45' of a greater spring force than spring 44 to rapidly return the armature to the rest position. The rearward projection 42 is also preferably provided with an opening to cooperate with the face 12c of end cap 12 to provide the aforementioned dash-pot action. FIG. 5 shows still another preferred embodiment 50 comprised of first and second flux rings 51 and 52. Flux ring 51 abuts against shoulder 11e of case 11. An annular shaped spring 53 has its outer marginal portion positioned between flux rings 51 and 52 and has a central opening of substantially large diameter. First and second springs 54 and 55 of substantially weak and substantially stronger spring force are secured to the rear end of armature 56. Spring 54 is shown in plan view in FIG. 9 and is comprised of an outer continuous ring 54a and inwardly directed spokes 54b whose free ends lie a spaced distance from adjacent spokes. The inner marginal portions of the free ends are embraced by spring retaining member 57 and secured to armature 56.

Spring 55 which has a smaller outer diameter than spring 54 may be of the type shown in FIG. 7 as being comprised of a continuous annular portion 55a having a central opening 55b and being provided with radially aligned outwardly directed spokes 55c. Alternatively, spring 55 may be a solid disc member 55' shown in plan view in FIG. 8, which spring has the same outer diameter of spring 55 shown in FIG. 7.

The continuous outer ring portion of 54a of spring 54 rests upon the rear surface 52a of flux ring 52.

When the solenoid coil is energized, armature 56 is initially biased only by spring 54. As the armature continues to move toward impact velocity, the outer periphery of solid disc spring member 55' or the outer free ends of spokes 55c engage the inner marginal portion of spring member 53 causing both spring members 53 and 55 (or 55') to undergo flexure. As soon as the solenoid coil is deenergized, armature 56 is rapidly driven toward the rest position by flexed springs 54, 55 and 53.

The embodiment 60 of FIG. 6 differs from that of FIG. 5 in that the first and second flux rings 51 and 52 are replaced by a single flux ring 61 having an inwardly directed shoulder 61a for ultimately engaging spring 55. In operation, as soon as the solenoid coil is energized, armature 56 is under the influence of only spring 54. Just as the armature is about to impinge print wire 21 upon the paper document, spring 55 bears against shoulder 61a to undergo flexure. When the solenoid coil is deenergized armature 56 is under the influence of both flexed springs 54 and 55 to rapidly return the armature to the rest position.

The armature configurations of FIGS. 1 and 2 minimize friction between the armature and the flux ring and between the armature and the coil winding. The fit between the springs and the armature serves to provide more accurate centering of the armature along the longitudinal axis of the solenoid assembly and further significantly reduces side loading forces. By forming the armature of a high permeability magnetic material such as silicon iron efficiency of operation is greatly increased. Reducing the penetration of the armature into the solenoid core and reduction of the mass of the armature further increases the acceleration rate. In the embodiment of FIG. 2, for example, the use of a double spring and the sliding movement therebetween greatly reduces the stress experienced by a single spring.

It can be seen from the foregoing description that the present invention provides a novel multiple spring solenoid assembly for use in impact printers of the dot matrix type and which is adapted to significantly increase solenoid operating speeds and hence printing speeds of printers of this category.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. A high speed solenoid assembly for driving a print wire comprising:

a housing;

armature means in said housing movable between an impact and a rest position;

first spring means normally stabily biasing said armature only towards the rest position;

solenoid means for urging said armature means towards said impact position;

second spring means for exerting a biasing force directed towards the rest position upon said armature means only after said armature means has moved a predetermined distance towards said impact position;

said first and second spring means cooperatively operating to rapidly return said armature means to said rest position when said coil means is deenergized.

2. The assembly of claim 1 wherein said first spring means is designed to exert a substantially weak biasing force upon said armature means to facilitate rapid acceleration thereof from the rest to the impact position.

3. The assembly of claim 1 wherein said second spring means is designed to exert a substantially thereof from the impact to the rest position.

4. The assembly of claim 1 wherein the spring constant of said second spring means is substantially greater than the spring constant of said first spring means to respectively enable rapid acceleration of said armature means towards the impact position under control of said coil means and rapid movement to said rest position predominantly under control of said second spring means.

5. The assembly of claim 1 wherein said armature means comprises a magnetic member having a portion thereof abutting said first spring means;

shoulder means positioned along said housing and having a bearing surface;

said first spring extending towards and engaging said shoulder means bearing surface and being flexed when said armature means moves towards said impact position.

6. The assembly of claim 5 wherein said shoulder means has a second bearing surface;

said second spring means resting upon said second bearing surface and extending towards said armature means;

said armature means having a projection spaced from said second spring means when said armature is in the rest position for engaging said second spring means after moving said predetermined distance.

7. The assembly of claim 5 wherein said shoulder means is an annular flux ring;

said first spring means comprising a first circular shaped substantially flat flexible metallic member;

said bearing surface comprising a continuous annular surface along said flux ring for engaging said first spring means;

the central portion of said first spring means being secured to said armature means.

8. The assembly of claim 7 wherein said second spring means comprises a second circular shaped substantially flat flexible metallic member;

said flux ring having a second continuous annular surface spaced inwardly from said first continuous annular surface;

the periphery of said second spring means engaging said second annular surface;

said second circular shaped metallic member having a central opening surrounding said armature means;

said armature means having a flange extending radially outwardly and lying a spaced distance from the periphery of the central opening in said second circular shaped metallic member when the armature means is in the rest position and adapted to engage said periphery when said armature means has moved said predetermined distance.

9. The assembly of claim 1 wherein said armature means comprises a solid cylindrical shaped magnetic member having a flange extending radially outward;

said first and second spring means each having a central opening;

annular shaped spacer means positioned between said first and second spring means;

said magnetic member extending respectively through the openings in said first spring means, said spacer and said second spring means;

a flux ring positioned in said housing and having an annular shoulder;

the outer periphery of said second spring means resting upon said shoulder;

the outer periphery of said second spring means being positioned a spaced distance from said annular shoulder when the armature is in the rest position and adapted to engage said shoulder when said armature means moves said predetermined distance.

10. The assembly of claim 9 further comprising a housing for said assembly and an end cap sealing said housing and protruding inwardly towards said armature means;

the inner surface of said cap being substantially flat;

said armature means having a first surface for engaging said end cap inner surface in the rest position;

said first surface having a depression which cooperates with said end cap inner surface to provide a dash-pot action for significantly reducing armature bounce when said armature means impacts said end cap in moving towards the rest position.

11. The assembly of claim 9 further comprising a housing for said assembly and an end cap sealing said housing and protruding inwardly towards said armature means;

the inner surface of said end cap being substantially flat;

said armature means having a first surface for engaging said end cap inner surface in the rest position;

said inner surface having a depression which cooperates with said armature first surface to provide a dashpot action for significantly reducing armature bounce when said armature means impacts said end cap in moving towards the rest position.

12. The assembly of claim 9 wherein said second spring means comprises first and second substantially circular shaped flat flexible metallic members engaging one another;

said first spring means comprising a third substantially circular shaped flat flexible metallic member having its inner periphery engaging said spacer ring and having its outer periphery engaging the shoulder of said flux ring;

the outer peripheries of said first and second metallic members being a spaced distance from said flux ring shoulder.

13. The assembly of claim 12 wherein at least one of said first, second and third metallic members comprises an annular shaped inner ring portion having a plurality of integrally joined spoke portions extending radially outward from said inner ring portion;

the free ends of said spoke portions having outward extending arcuate shaped arms collectively forming a discontinuous outer ring portion; the free ends of adjacent arcuate arms of adjacent spoke portions lying a spaced distance apart.

14. The assembly of claim 12 wherein at least one of said first and second metallic members comprises an annular shaped inner ring portion having a plurality of integrally joined spoke portions extending radially outward from said inner ring portion;

the free ends of said spoke portions having outward extending arcuate shaped arms collectively forming a discontinuous outer ring portion; the free ends of adjacent arcuate arms of adjacent spoke portions lying a spaced distance apart.

15. The assembly of claim 1 wherein said armature means comprises a cylindrical shaped magnetic body having an enlarged head at one end thereof forming a bearing shoulder;

said first and second spring means each being circular in shape and having central openings receiving said armature cylindrical body;

said first spring means having a larger diameter than said second spring means;

a flux ring surrounding said armature means and having first and second spaced annular shoulders, said second shoulder being spaced inwardly from said first shoulder;

the outer periphery of said first spring means engaging said first shoulder;

the outer edge of said second spring means being spaced radially inwardly from said first shoulder and lying a spaced distance above said second shoulder when the armature means is in the rest position and adapted to engage said second shoulder when the armature means has moved said predetermined distance towards said impact position.

16. The assembly of claim 1 wherein said armature means comprises a cylindrical shaped magnetic body having an enlarged head at one end thereof forming a bearing shoulder;

said first and second spring means each being circular in shape and having central openings receiving said armature cylindrical body;

said first spring means having a larger diameter than said second spring means;

a flux ring surrounding said armature means and having first and second spaced annular shoulders on opposite sides of said ring;

third annular shaped spring means having its outer periphery engaging said second shoulder and having a large central opening surrounding and spaced from said armature cylindrical body;

the outer periphery of said first spring means engaging said first shoulder;

the outer periphery of said second spring means being spaced radially inwardly from said ring and lying a spaced distance above said third spring means when the armature means is in the rest position and adapted to engage the inner periphery of said third spring means when the armature means has moved said predetermined distance towards said impact position.

17. A solenoid assembly comprising an annular shaped housing;

a selectively energizable annular shaped solenoid coil having a hollow core and being positioned in said housing;

a core stem of magnetic material extending through the entire axial length of said hollow core;

said core stem having an elongated axially aligned opening;

an elongated slender print wire extending through said axial opening;

a cylindrical shaped armature of magnetic material positioned adjacent the rear end of said core stem and being secured to the rear end of said print wire, said armature being movable between a rest and an impact position;

annular shoulder means provided along the interior wall of said housing;

flexible cylindrical shaped spring means having a central portion engaging said armature and an outer periphery engaging said shoulder means for normally urging said armature away from said core stem;

an end cap sealing the rear end of said housing and having an inner face extending into said housing;

the rear surface of said armature engaging the inner face of said end cap when in said rest position.

18. The assembly of claim 17 wherein the rear surface of said armature is provided with a depression cooperating with said end cap surface for providing a dashpot action to reduce armature bounce when said armature engages said end cap in moving towards said rest position.

* * * * *